US011322282B2

(12) United States Patent
Sen et al.

(10) Patent No.: US 11,322,282 B2
(45) Date of Patent: May 3, 2022

(54) ELECTROMAGNETIC ACTUATOR

(71) Applicant: Robert Bosch GmbH, Stuttgart (DE)

(72) Inventors: Mehmet-Fatih Sen, Hemmingen (DE); Klaus Schudt, Nordheim (DE)

(73) Assignee: Robert Bosch GmbH, Stuttgart (DE)

( * ) Notice: Subject to any disclaimer, the term of this patent is extended or adjusted under 35 U.S.C. 154(b) by 156 days.

(21) Appl. No.: 16/597,210

(22) Filed: Oct. 9, 2019

(65) Prior Publication Data

US 2020/0118724 A1 Apr. 16, 2020

(30) Foreign Application Priority Data

Oct. 11, 2018 (DE) ..... 102018217424.5

(51) Int. Cl.
*H01F 7/16* (2006.01)
*H01F 7/126* (2006.01)
*H01F 7/08* (2006.01)

(52) U.S. Cl.
CPC ..... *H01F 7/1607* (2013.01); *H01F 7/081* (2013.01); *H01F 7/126* (2013.01)

(58) Field of Classification Search
CPC .. H01F 7/081; H01F 2007/085; H01F 7/1607; F16K 31/0675
See application file for complete search history.

(56) References Cited

U.S. PATENT DOCUMENTS

2016/0084397 A1* 3/2016 Boban ..... F16K 3/0209 137/238
2016/0148738 A1* 5/2016 Yoshizawa ..... H01F 7/1607 335/255

FOREIGN PATENT DOCUMENTS

DE 102006055796 A1 5/2008

* cited by examiner

*Primary Examiner* — Ramon M Barrera
(74) *Attorney, Agent, or Firm* — Norton Rose Fulbright US LLP; Gerard Messina

(57) ABSTRACT

An electromagnetic actuator includes an essentially cylindrical pole tube, an armature situated radially within the pole tube, and an electromagnetic coil situated radially outside of the pole tube, the pole tube including a first axial end area, a second axial end area, and an outer recess, which extends in the circumferential direction, in proximity to the first axial end area on an outer side of the pole tube. On an inner side, the pole tube includes an inner recess that extends in the circumferential direction and whose axial extension is smaller than an axial extension of the outer recess and that is situated approximately at the height of an edge area of the outer recess pointing away from the second axial end area viewed in the axial direction.

11 Claims, 3 Drawing Sheets

ELECTROMAGNETIC ACTUATOR

CROSS-REFERENCE TO RELATED APPLICATIONS

The present application claims priority under 35 U.S.C. § 119 to DE 10 2018 217 424.5 filed in the Federal Republic of Germany on Oct. 11, 2018, the content of which is hereby incorporated by reference herein in its entirety.

FIELD OF THE INVENTION

The present invention relates to an electromagnetically actuated valve device, including an electromagnetic actuator.

BACKGROUND

Electromagnetic actuators are used in particular in so-called direct-action control elements in the transmission technology in motor vehicles. Direct-action control elements are electromagnetically actuated hydraulic valves that control the clutches of a transmission, for example. Important variables of such electromagnetic actuators are a wide area of usage having a negative gradient (magnetic force against armature lift) and a high magnetic force in the case of maximum current. To achieve this, a so-called bridge is implemented at the pole tube of the electromagnetic actuator in that, in the proximity of an axial end area on an outer side, the pole tube includes an outer recess extending in the circumferential direction. The bridge represents a magnetic resistance that is switched in parallel to an armature and thus reduces the energy yield at the armature. This is described, for example, in DE 10 2006 055 796 A1.

SUMMARY

According to an example embodiment of the present invention, an electromagnetic actuator is provided that includes an overall essentially cylindrical pole tube. Here, it is understood that "essentially cylindrical" involves that the pole tube is cylindrical or tubular but can include collars, steps, grooves, wall thickness changes, etc. A (solenoid) armature is situated radially within the pole tube and guided in a sliding fit directly or indirectly through the pole tube and an electromagnetic coil is situated radially outside of the pole tube. This corresponds to the typical arrangement of an electromagnetic actuator.

The pole tube includes a first axial end area and a second axial end area and has an outer recess extending in the circumferential direction of the pole tube in proximity of the first axial end area on an outer side, i.e., on an outer lateral area. This recess, which has a groove-like design, for example, preferably continuously extends in the circumferential direction and is situated in proximity of that axial end of the pole tube toward which the armature is pulled in the case of an energized coil (in this respect, this axial end belongs to the first axial end area of the pole tube). A so-called bridge is implemented in this manner, i.e., a cylindrical section that has a comparatively minor wall thickness and via which the magnetic field or the magnetic force is influenced.

In addition to the outer recess, the pole tube includes an inner recess, which extends in the circumferential direction and is preferably also continuous, on an inner side, i.e., in an inner lateral area. This inner and, for example, groove-like recess can be designed as an insertion, for example. An extension of the inner recess in the axial direction of the pole tube is smaller than an extension of the outer recess in the axial direction. Viewed in the axial direction, the inner recess is approximately at the height of the axial edge area of the outer recess pointing away from the second axial end area of the pole tube.

The term "approximately at the height" is to be understood in a broad sense. On the one hand, the edge area of the outer recess can be designed differently and have a certain axial extension itself and this axial extension of the edge area can be larger than the axial extension of the inner recess. On the other hand, the inner recess can also be just or directly next to the above-mentioned edge area of the outer recess, viewed in the axial direction.

If the above-mentioned inner recess is inserted at the pole tube in the area of the bridge exactly in the above-described position in relation to the outer recess, the area of the force/lifting curve having a negative gradient is significantly enlarged and thus the lifting work of the electromagnet is essentially greater. The material tapering of the pole tube resulting from the inner recess is delimited in this case to a small area and reduces the material stiffness of the pole tube only to a minor extent. By appropriately dimensioning the radial extension of the inner recess, an enlargement of the area having a negative gradient is achieved to approximately the same length as in the case of a split pole tube, in which the bridge is cut through. In this case, it is understood that the provided inner recess is in particular reasonable if the bridge is made of a soft-magnetic material or includes such a material.

In an example embodiment, the inner recess has an approximately rectangular or trapezoid cross section. In terms of manufacture, this can be implemented very easily and is particularly efficient with regard to the implementation of the magnetic force. Here, the circumferential edges can be slightly rounded to reduce tension peaks in the material. However, it is in principle also conceivable that the inner recess has a triangular or a semicircular cross section, for example.

In an example embodiment, the outer recess has a cylinder section that runs essentially in parallel to a longitudinal axis of the pole tube; the edge area of the outer recess pointing away from the second axial end area of the pole tube has an oblique transition section; and the inner recess is situated approximately at the height of the transition from the cylinder section into the oblique transition section. This is particularly favorable with regard to the implementation of the magnetic force.

In an example embodiment, the end of the inner recess pointing away from the second axial end area of the pole tube is situated at approximately the same height as the end of the cylinder section of the outer recess pointing away from the second axial end area of the pole tube, i.e., the above-mentioned ends are flush so to speak. This is optimal with regard to the implementation of the magnetic force. "Approximately at the same height" is in the present case in particular understood as a position accuracy of +/−0.5 mm.

In an example embodiment, the axial extension of the inner recess is in the range of approximately 15% to 50% of the axial extension of the outer recess, in particular of a cylinder section of the outer recess. This is optimal with regard to the magnetic resistance.

In an example embodiment, the radial extension of the inner recess is approximately in the range of 0.1 mm to 0.4 mm, which has advantages with regard to the manufacturability.

In an example embodiment, the axial extension of the inner recess is in the range of 0.4 mm to 1.3 mm, which, on the one hand, has advantages with regard to stability and, on the other hand, is favorable with regard to sufficiently guiding the armature in the pole tube and preventing the armature from canting in the pole tube.

In an example embodiment, a wall thickness of the pole tube in the area of the inner recess is in the range of 0.15 mm to 0.35 mm, thus ensuring an overall sufficient stiffness of the pole tube.

In an example embodiment, a film (bearing film) covering the inner recess is situated between the armature and the inner wall of the pole tube. The inner recess is conceivable in principle in the case of an armature bearing without an additional bearing film. However, in particular in combination with the above-described bearing film, there are functional advantages, since, as a result of the bearing film, the surface defect is covered by the inner recess and the armature is therefore continuously able to glide in the pole tube with little friction or disturbance. The film is advantageously produced from a PTFE-coated glass fabric, for example.

One example embodiment of the present invention is elucidated below with reference to the appended drawings.

DETAILED DESCRIPTION

Figure 1:
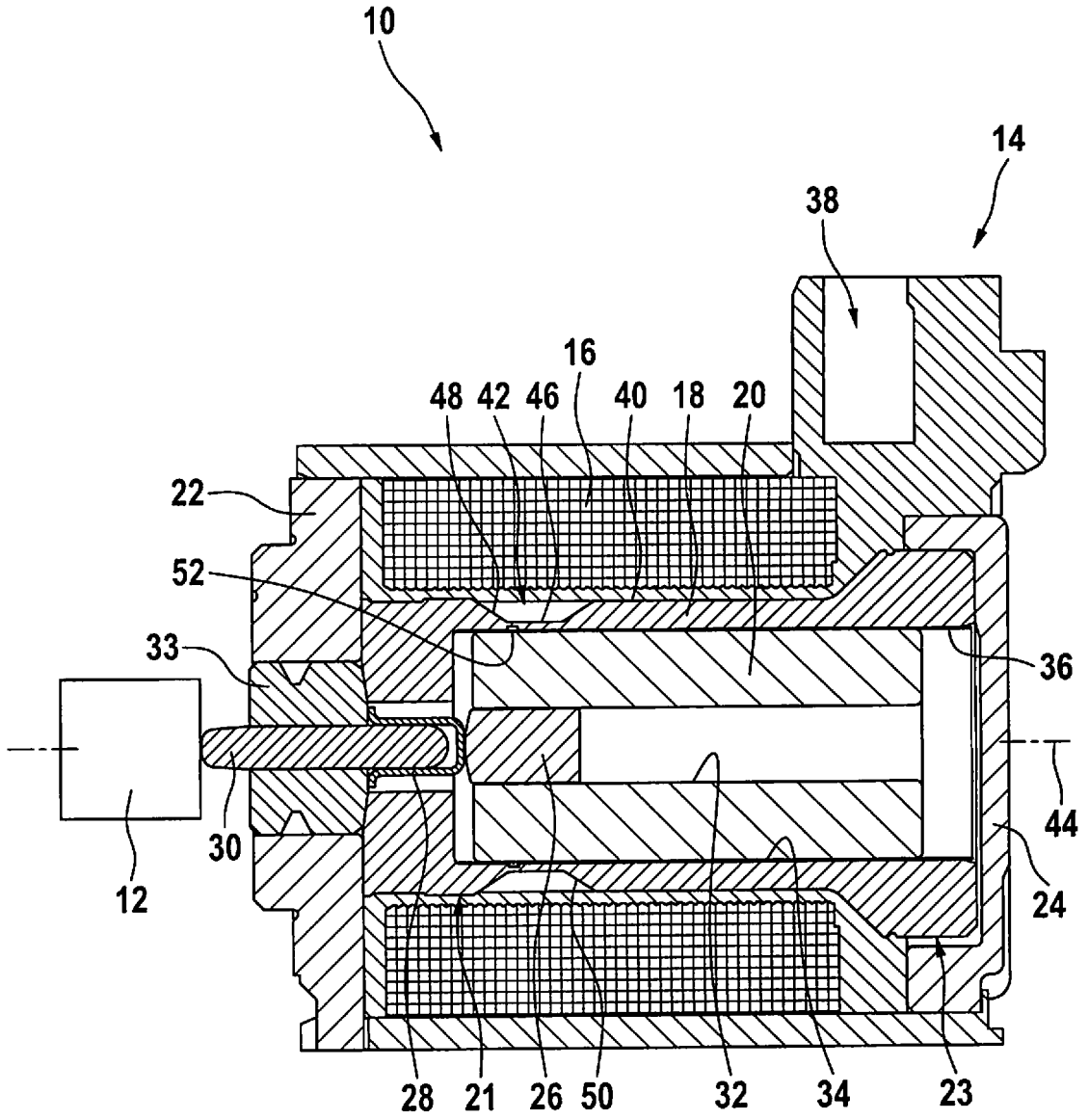
FIG. 1 schematically illustrates a section through an electromagnetic actuator according to an example embodiment of the present invention.

In FIG. 1, an electromagnetic actuator is identified as a whole by reference numeral 14. Such an electromagnetic actuator 14 is, for example, used in the transmission technology in motor vehicles, in particular for controlling a clutch of an automatic transmission. For this purpose, a hydraulic valve, which is merely schematically indicated in FIG. 1 by a box provided with reference numeral 12, is actuated by electromagnetic actuator 14.

Electromagnetic actuator 14 includes a coil 16 that is situated about a pole tube 18. An armature 20 is glidingly mounted in pole tube 18. At a first axial end area 21 of pole tube 18 (on the left-hand side in FIG. 1), a circular disk-shaped flux washer 22 is put on pole tube 18 or connected thereto. At a second axial end area 23 of the pole tube (on the right-hand side in FIG. 1), a further flux washer 24 is fastened to pole tube 18.

Three power transmission elements 26, 28, and 30 are positioned at armature 20. Power transmission element 26 is pressed into a continuous axial recess 32 of armature 20. Power transmission element 28, which is designed as a pot-shaped sleeve, is in contact with power transmission element 26. Power transmission element 30, which is designed as a tappet, is, in turn, pressed into power transmission element 28. A guiding ring 33 for power transmission element 30 is pressed into flux washer 22. The latter is used as a stop for power transmission element 28. Power transmission element 30, in turn, acts on hydraulic valve 12.

As mentioned above, armature 20 is mounted glidingly in pole tube 18. To improve the mounting, a bearing film 36 made of a Teflon-coated glass fiber fabric is applied between armature 20 and an inner side 34 of pole tube 18 formed by an inner lateral area. Coil 16 is made of a winding element that includes by way of example in the present case a copper wire having a certain number of windings and through which an electric current flows when energized. The latter is controlled or regulated by a control unit (not illustrated in the drawing). Coil 16 and the control unit are electrically connected to each other using connecting lines (also not illustrated) via an electrical contact element 38.

Electromagnetic actuator 14 works as follows. Depending on the intensity of the electric current flowing through coil 16, an electromagnetic force is generated that acts on armature 20 and pulls armature 20 out of a starting position (on the right-hand side in FIG. 1) into an end position (depicted on the left-hand side in FIG. 1). In this end position, the lift of armature 20 is delimited by power transmission element 28 that acts as the stop element and at which guiding ring 33 comes to rest. If the energization of coil 16 is terminated, armature 20 is moved back into the (right-hand) starting position together with the three power transmission elements 26, 28, and 30 using a spring (not depicted in the drawing), which is braced between pole tube 18 and armature 20, for example, and/or using a hydraulic force acting on power transmission element 30 via hydraulic valve 12.

In the proximity of first axial end area 21, a groove-like outer recess 42 extending in the circumferential direction is present on an outer side 40 of pole tube 18 that is formed from an outer lateral area. In the present case, this recess has, for example, a central cylinder section 46 viewed in the axial direction, that runs in parallel to a longitudinal axis 44 of the pole tube. An edge area 48 that points away from second axial end area 23 of pole tube 18 and that is formed by an oblique transition section further belongs to outer recess 42. Moreover, an edge area 50 that points toward second axial end area 23 of pole tube 18 and that is also formed by an oblique transition section belongs to outer recess 42. In the present case, outer recess 42 has in this respect an approximately trapezoid cross section by way of example.

On its inner side 34, pole tube 18 further has an inner recess 52 also extending in the circumferential direction. It is readily apparent from FIG. 1, and in particular also from the enlarged illustrations in FIGS. 2 and 3, that an axial extension 54 of inner recess 52 in the direction of longitudinal axis 44, i.e., viewed in the axial direction of pole tube 18, is considerably smaller than an axial extension of outer recess 42, in particular considerably smaller than an axial extension 55 of cylinder section 46 of outer recess 42.

Moreover, inner recess 52, viewed in the above-mentioned axial direction, is situated approximately at the height of edge area 48 of outer recess 42 pointing away from second axial edge area 23, i.e., directly adjacent thereto, so that the end (reference numeral 56 in FIG. 3) of inner recess 52 pointing away from second axial end area 23 of pole tube 18 is approximately at the same height as end 58 of cylinder section 46 of outer recess 42 pointing away from second axial end area 23. It is thus also possible to say that end 56 (on the left-hand side in the figures) of inner recess 52 is flush with end 58 (on the left-hand side in the figures) of cylinder section 46 or the start of oblique transition section 48 situated there. It is advantageous for the positioning to be at this point at an accuracy of approximately +/−0.5 mm to be able to achieve advantages and effects of inner recess 42 on the magnetic force.

Figure 2:
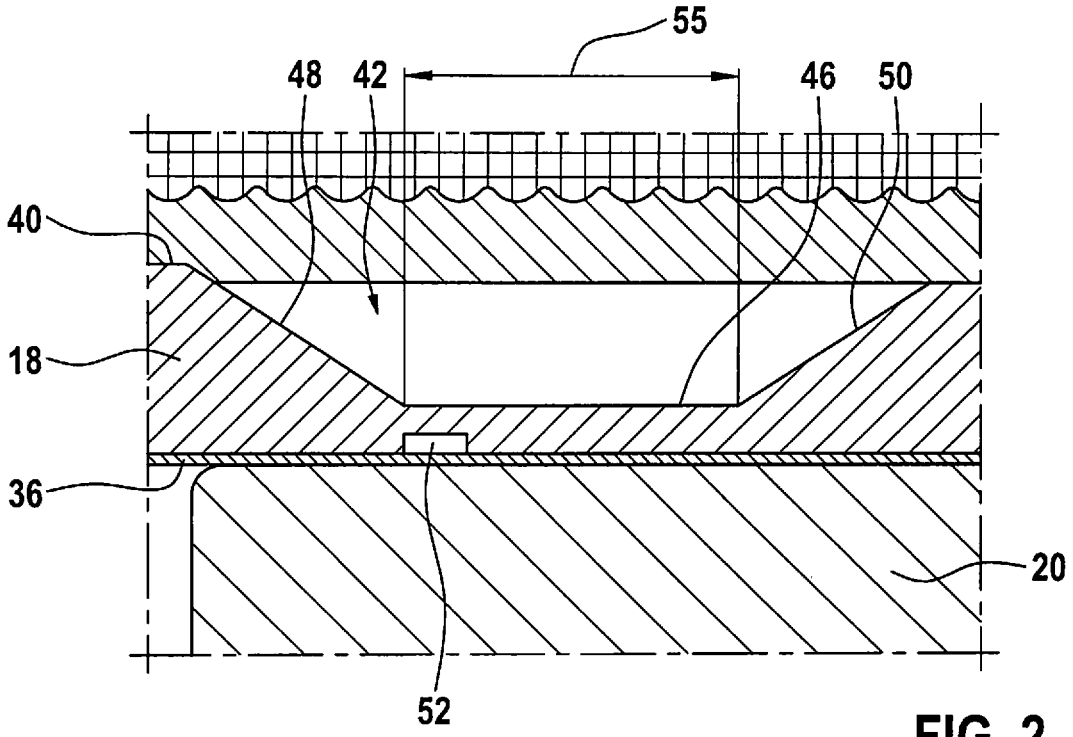
FIG. 2 shows an enlarged detail of the electromagnetic actuator of FIG. 1 according to an example embodiment of the present invention.

It is readily apparent from FIG. 2, for example, that axial extension 54 of inner recess 52 is in a range of approximately 15% to 50% of the axial extension (without reference numeral) of outer recess 42, in particular of cylinder section 46 of outer recess 42, and is preferably in the range of 0.4 mm to 1.3 mm. The lower limit ensures the manufacturability and the upper limit prevents armature 20 from canting. A radial extension 60 of inner recess 52 is approximately in the range of approximately 0.1 mm to 0.4 mm. A wall thickness 62 of pole tube 18 is in the area of inner recess 52 in the range of approximately 0.15 mm to 0.35 mm. Viewed in the axial direction of pole tube 18, the wall thickness next to inner recess 52, however still in the area of cylinder section 46 of the outer recess, should also be maximally 0.45 mm, also due to the resistance.

Figure 3:
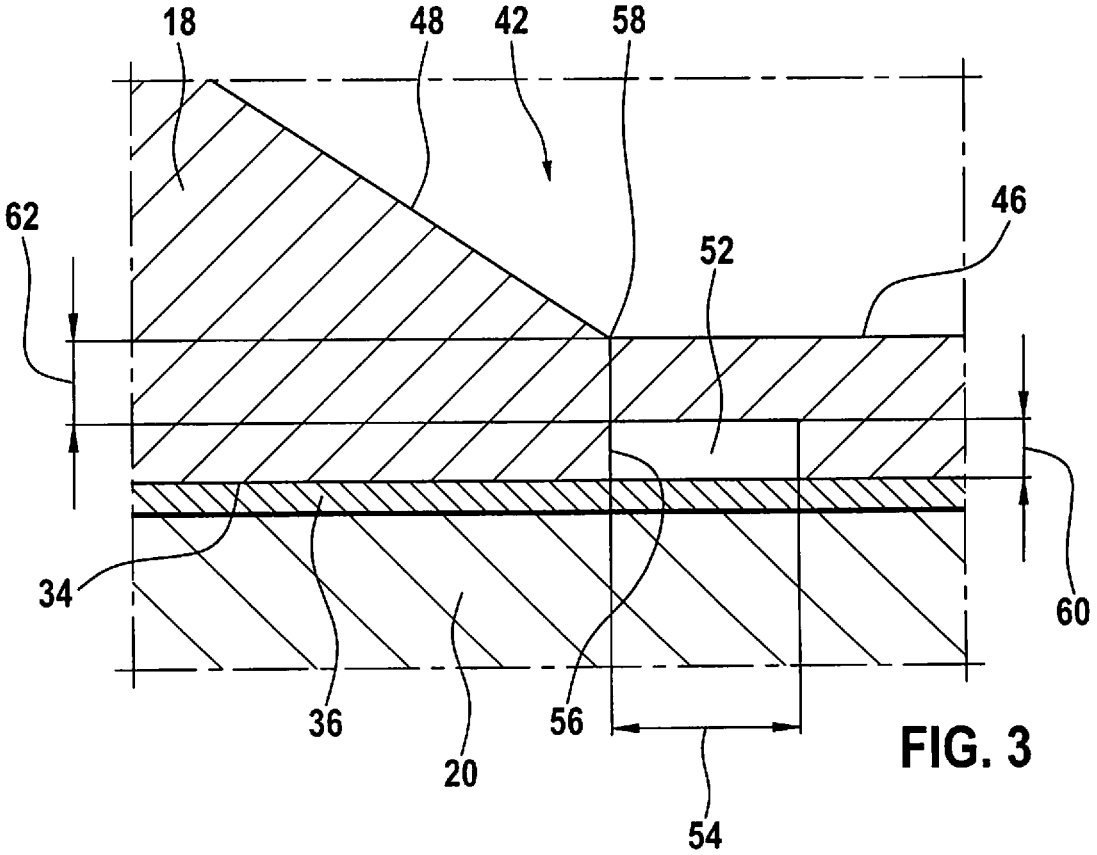
FIG. 3 shows an enlarged detail of FIG. 2 according to an example embodiment of the present invention.

As is also apparent from FIG. 3, for example, inner recess 52 is completely covered by film 36. The axial extension of inner recess 52, which is kept excessively short, and film 36, lying underneath, prevent armature 20 from canting.

Figure 4:
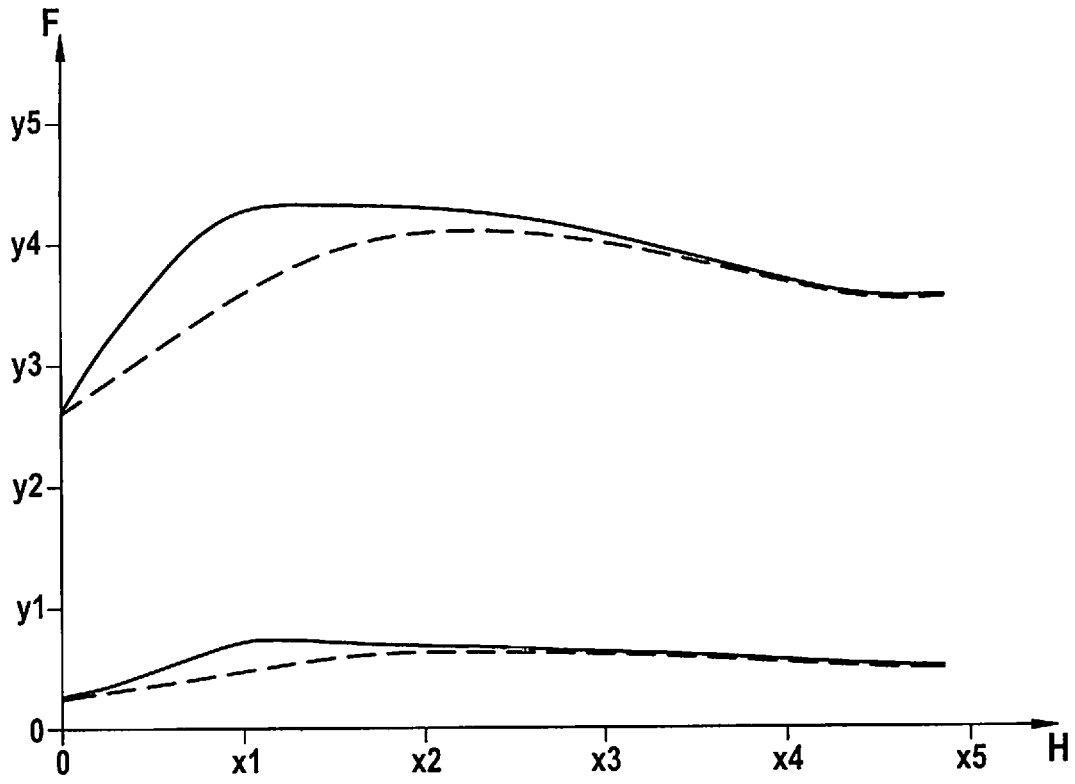
FIG. 4 is a diagram that plots magnetic force against an armature-lift of the electromagnetic actuator according to an example embodiment of the present invention.

In FIG. 4, the progression of magnetic force F is plotted against lift H, i.e., one time in the case of a relatively lightly energized coil 16 (lower curves) and one time in the case of a relatively strongly energized coil 16 (upper curves). The progression of magnetic force F in the form of a dashed line is illustrated for the case that pole tube 18 would not have inner recess 52 and the progression of magnetic force F in the form of a solid line is illustrated for the case that is depicted in FIGS. 1-3 and in which pole tube 18 has inner recess 52 at the depicted position. It is clearly apparent that an area ("area of usage") of a progression of magnetic force F, which has a comparatively small negative gradient by way of example in the present case and is relatively lightly curved, is considerably enlarged in both cases as a result of inner recess 52. The range having a negative gradient starts in both cases already at lift x1.

What is claimed is:

1. An electromagnetic actuator comprising:
an electromagnetic coil;
an essentially cylindrical pole tube that is situated radially within the electromagnetic coil and includes:
a first axial end;
a second axial end;
an outer recess that extends in a circumferential direction near the first axial end on an outer side of the pole tube; and
an inner recess that:
extends in the circumferential direction;
extends axially with an axial extension that is smaller than an axial extension of the outer recess;
is situated, in an axial direction, approximately at a first edge area of the outer recess that is, relative to the second axial end area, more distal than a second edge area of the outer recess opposite the first edge area; and
overlaps the outer recess along a plane perpendicular to a central longitudinal axis of the pole tube; and
an armature situated radially within the pole tube.

2. The electromagnetic actuator of claim 1, wherein the inner recess has an approximately rectangular or trapezoid cross section.

3. The electromagnetic actuator of claim 1, wherein the axial extension of the inner recess is in the range of approximately 15% to 50% of the axial extension of the outer recess.

4. The electromagnetic actuator of claim 1, wherein the axial extension of the inner recess is in the range of approximately 15% to 50% of an axial extension of a cylinder section of the outer recess.

5. The electromagnetic actuator of claim 1, wherein a radial extension of the inner recess is approximately in a range of 0.1 mm to 0.4 mm.

6. The electromagnetic actuator of claim 1, wherein the axial extension of the inner recess is approximately in a range of 0.4 mm to 1.3 mm.

7. The electromagnetic actuator of claim 1, wherein a wall thickness of the pole tube in an axial position of the inner recess is approximately in a range of 0.15 mm to 0.35 mm.

8. An electromagnetic actuator comprising:
an electromagnetic coil;
an essentially cylindrical pole tube that is situated radially within the electromagnetic coil and includes:
a first axial end;
a second axial end;
an outer recess that extends in a circumferential direction near the first axial end on an outer side of the pole tube; and
an inner recess that:
extends in the circumferential direction;
extends axially with an axial extension that is smaller than an axial extension of the outer recess; and
is situated, in an axial direction, approximately at a first edge area of the outer recess that is, relative to the second axial end area, more distal than a second edge area of the outer recess opposite the first edge area; and
an armature situated radially within the pole tube,
wherein:
the outer recess includes a cylinder section that runs essentially in parallel to a central longitudinal axis of the pole tube;
the first edge area of the outer recess includes an oblique transition section; and
the inner recess is situated approximately at an axial position of a transition from the cylinder section to the oblique transition section.

9. An electromagnetic actuator comprising:
an electromagnetic coil;
an essentially cylindrical pole tube that is situated radially within the electromagnetic coil and includes:
a first axial end;
a second axial end;
an outer recess that extends in a circumferential direction near the first axial end on an outer side of the pole tube; and
an inner recess that:
extends in the circumferential direction;
extends axially with an axial extension that is smaller than an axial extension of the outer recess; and
is situated, in an axial direction, approximately at a first edge area of the outer recess that is, relative to the second axial end area, more distal than a second edge area of the outer recess opposite the first edge area; and
an armature situated radially within the pole tube,
wherein:
the outer recess includes a cylinder section that runs essentially in parallel to a central longitudinal axis of the pole tube;
the first edge area of the outer recess includes an oblique transition section; and an end of the inner recess that is distal from the second axial end area is situated approximately at an axial position of a transition from the cylinder section to the oblique transition section.

10. An electromagnetic actuator comprising:

an electromagnetic coil;

an essentially cylindrical pole tube that is situated radially within the electromagnetic coil and includes:

a first axial end;

a second axial end;

an outer recess that extends in a circumferential direction near the first axial end on an outer side of the pole tube; and an inner recess that:

extends in the circumferential direction;

extends axially with an axial extension that is smaller than an axial extension of the outer recess; and is situated, in an axial direction, approximately at a first edge area of the outer recess that is, relative to the second axial end area, more distal than a second edge area of the outer recess opposite the first edge area; and an armature situated radially within the pole tube, wherein:

the outer recess includes a cylinder section that runs essentially in parallel to a central longitudinal axis of the pole tube;

the first edge area of the outer recess includes an oblique transition section; and an end of the inner recess that is distal from the second axial end area is situated, with respect to the axial direction, within 0.5 mm of an axial position of a transition from the cylinder section to the oblique transition section.

11. An electromagnetic actuator comprising:

an electromagnetic coil;

an essentially cylindrical pole tube that is situated radially within the electromagnetic coil and includes:

a first axial end;

a second axial end;

an outer recess that extends in a circumferential direction near the first axial end on an outer side of the pole tube; and an inner recess that:

extends in the circumferential direction;

extends axially with an axial extension that is smaller than an axial extension of the outer recess; and is situated, in an axial direction, approximately at a first edge area of the outer recess that is, relative to the second axial end area, more distal than a second edge area of the outer recess opposite the first edge area; and an armature situated radially within the pole tube, a film that is situated between the armature and a radially interior side of the pole tube and that covers a radially interior side of the inner recess.

* * * * *